US009827786B2

(12) United States Patent
Matsuhashi et al.

(10) Patent No.: US 9,827,786 B2
(45) Date of Patent: Nov. 28, 2017

(54) RECORDING APPARATUS AND RECORDING METHOD

(71) Applicant: SEIKO EPSON CORPORATION, Tokyo (JP)

(72) Inventors: Kunihiko Matsuhashi, Matsumoto (JP); Eiji Natori, Chino (JP); Shinya Momose, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/324,645

(22) PCT Filed: Jul. 1, 2015

(86) PCT No.: PCT/JP2015/003313
§ 371 (c)(1),
(2) Date: Jan. 6, 2017

(87) PCT Pub. No.: WO2016/006209
PCT Pub. Date: Jan. 14, 2016

(65) Prior Publication Data

US 2017/0203579 A1 Jul. 20, 2017

(30) Foreign Application Priority Data

Jul. 11, 2014 (JP) ..... 2014-142941

(51) Int. Cl.
*B41J 2/01* (2006.01)
*B41J 3/407* (2006.01)
(Continued)

(52) U.S. Cl.
CPC ..... *B41J 3/4073* (2013.01); *B41J 11/002* (2013.01); *B41J 15/16* (2013.01); *B41M 5/0082* (2013.01)

(58) Field of Classification Search
CPC ..... B41J 3/4073; B41J 11/002; B41J 15/16; B41J 13/22
(Continued)

(56) References Cited

U.S. PATENT DOCUMENTS

2003/0197772 A1 10/2003 Iwatsuki et al.
2006/0144261 A1 7/2006 Uptergrove

FOREIGN PATENT DOCUMENTS

JP 2000-280567 10/2000
JP 2002-084407 3/2002
(Continued)

OTHER PUBLICATIONS

International Search Report dated Aug. 11, 2015 for PCT/JP2015/003313.

*Primary Examiner* — An Do
(74) *Attorney, Agent, or Firm* — Workman Nydegger

(57) ABSTRACT

To suppress deterioration in the quality of a recorded image resulting from the shape of a medium not being stable. There is provided a recording apparatus (1) including a shape adjusting section (11) which adjusts a shape of a medium (M) to a reference shape, a holding section (10) which holds a state of the medium (M) after being adjusted by the shape adjusting section (11), and a recording section (44) which has a discharging section (6) which discharges a liquid to the medium (M) which is held by the holding section (10). With the recording apparatus (1) having this configuration, it is possible to suppress deterioration in the quality of a recorded image resulting from the shape of the medium (M) not being stable.

9 Claims, 11 Drawing Sheets

(51) Int. Cl.

| | |
|---|---|
| ***B41J 11/00*** | (2006.01) |
| ***B41J 15/16*** | (2006.01) |
| ***B41M 5/00*** | (2006.01) |

(58) Field of Classification Search
USPC ..... 347/104, 110; 101/35
See application file for complete search history.

(56) References Cited

FOREIGN PATENT DOCUMENTS

| | | |
|---|---|---|
| JP | 2003-072055 | 3/2003 |
| JP | 2009-184112 | 8/2009 |
| WO | 2011162071 | 12/2011 |

[Fig. 1]
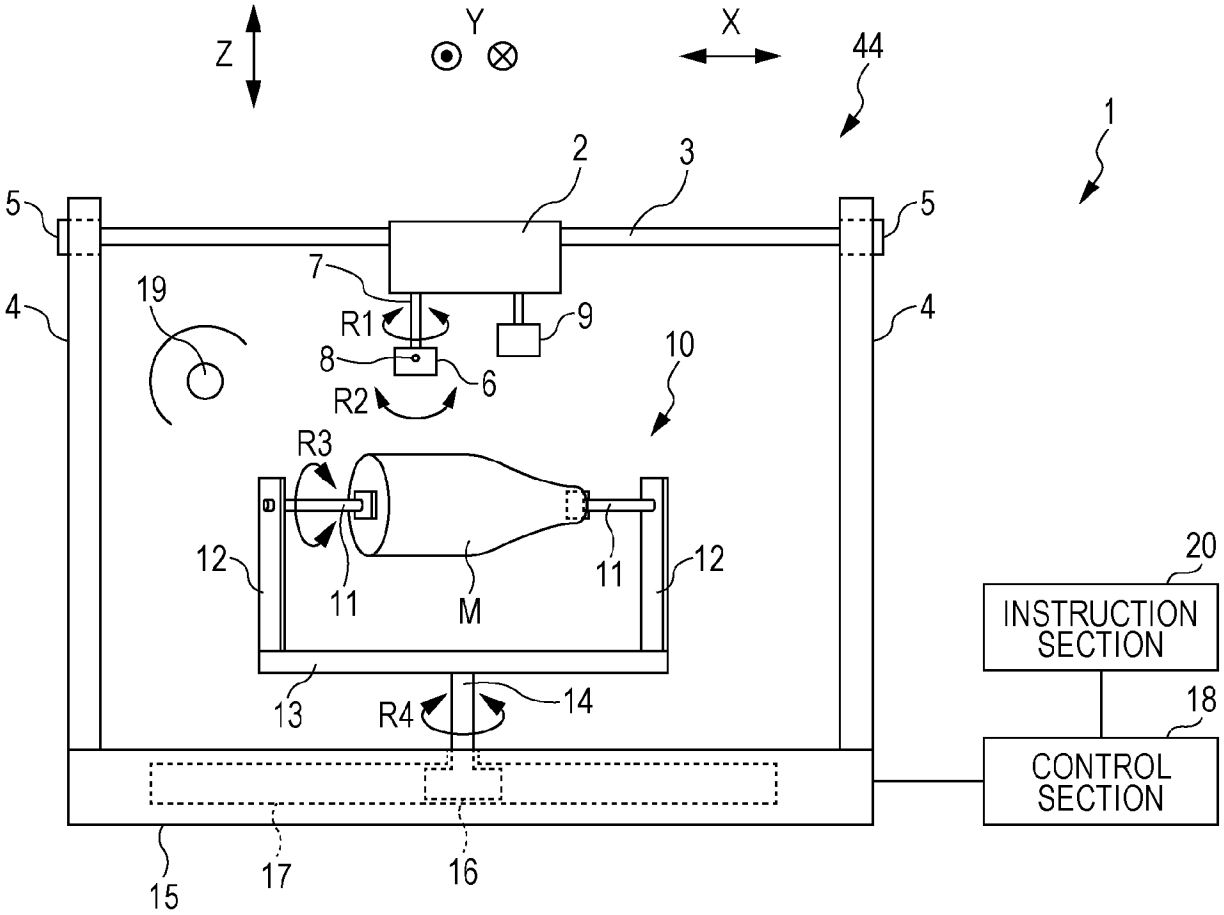

[Fig. 2]
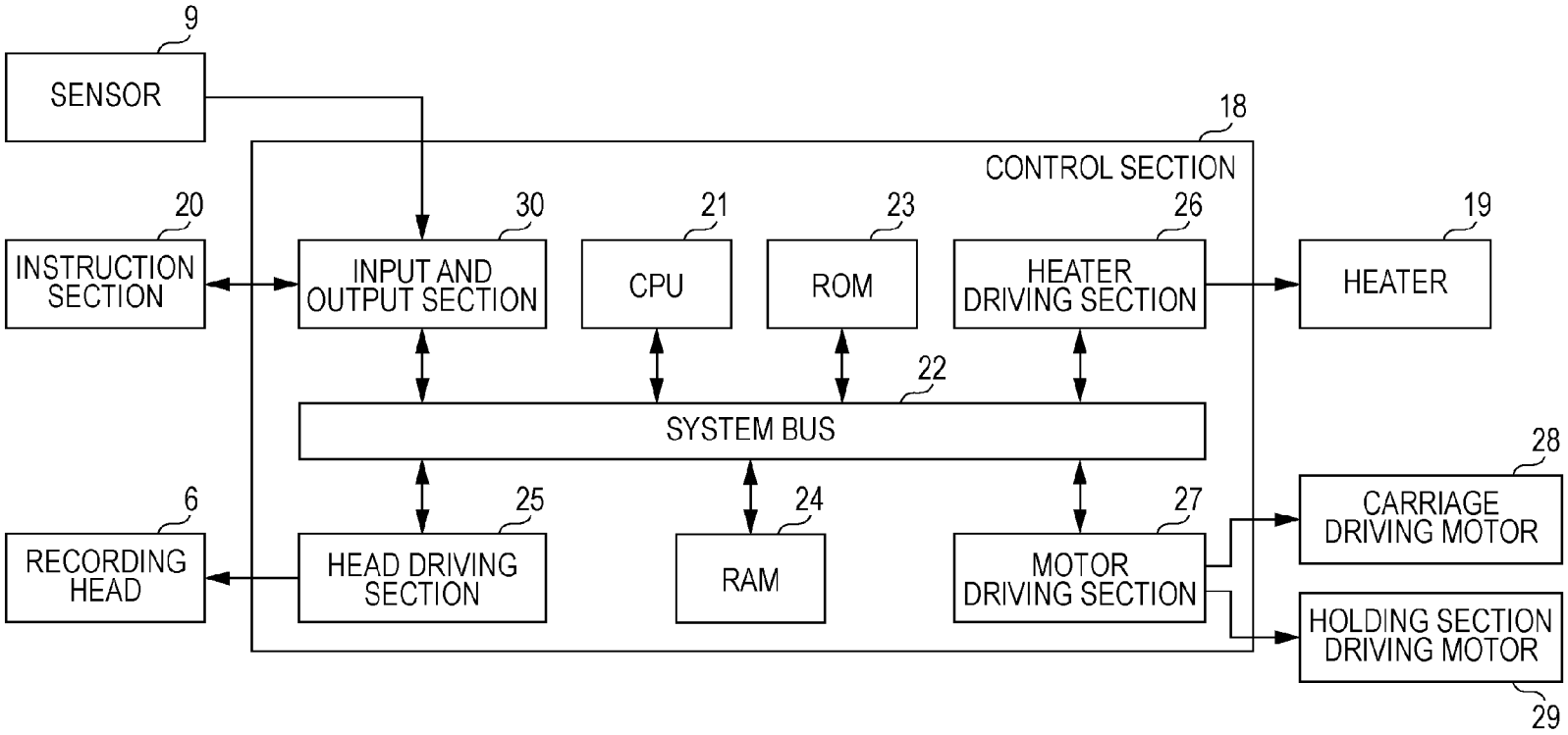

[Fig. 3]
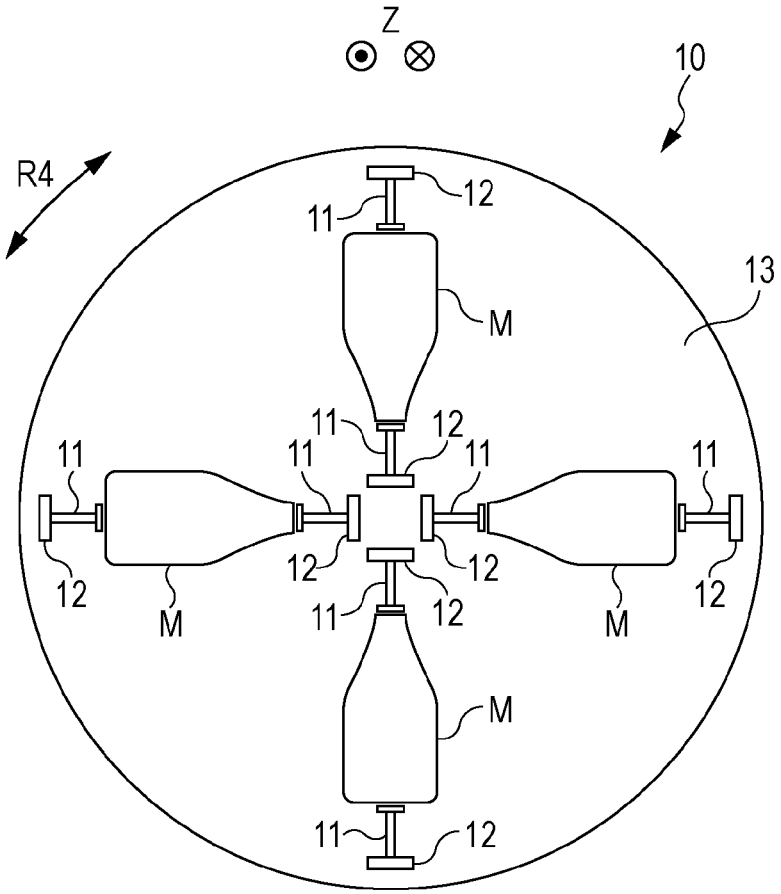

[Fig. 4]
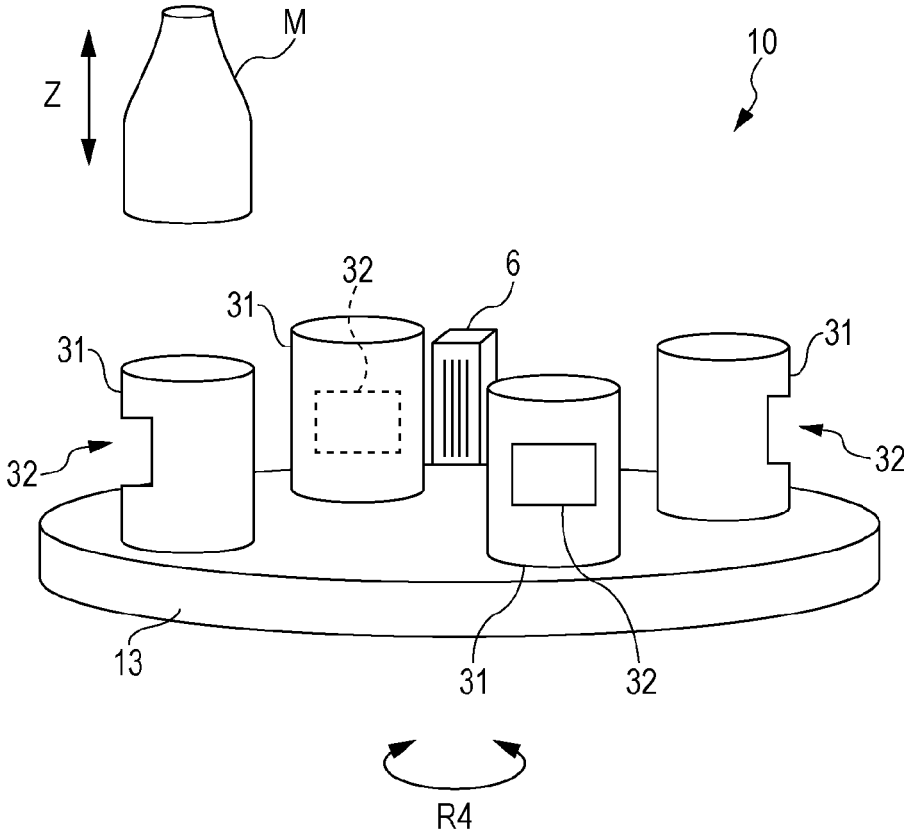
[Fig. 5A]
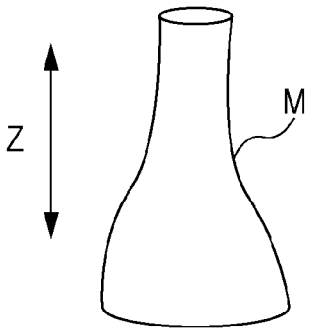

[Fig. 5B]
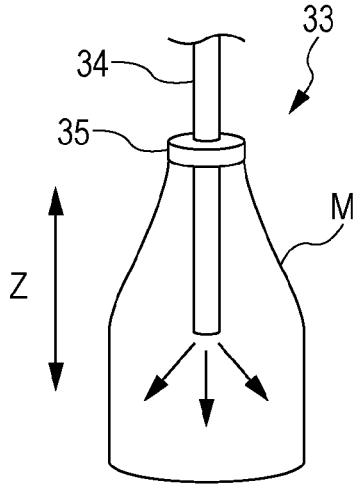
[Fig. 6A]
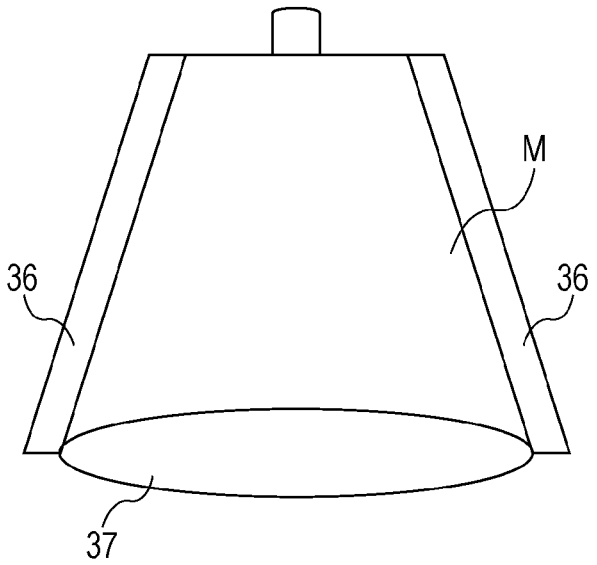

[Fig. 6B]
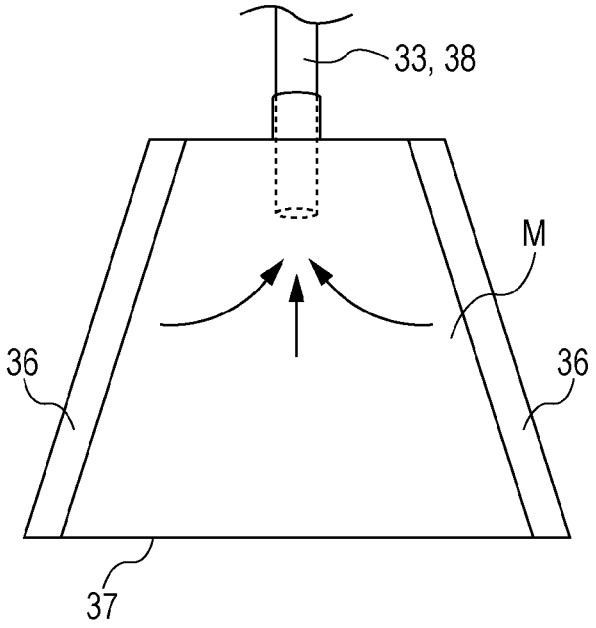
[Fig. 7A]
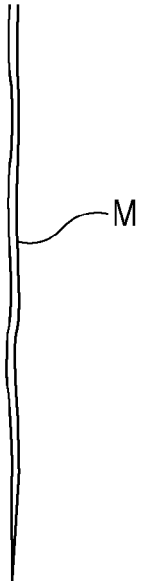

[Fig. 7B]
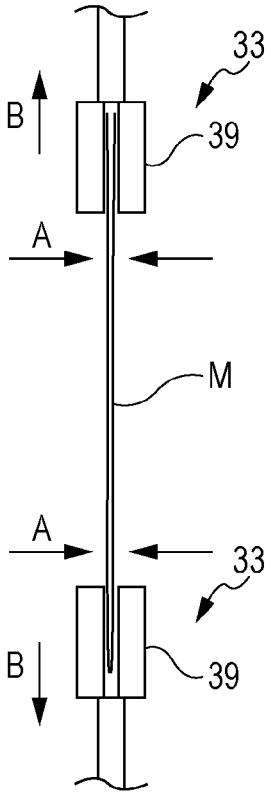

[Fig. 7C]
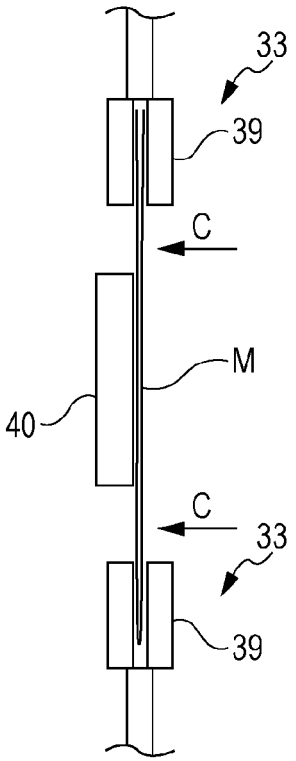
[Fig. 8A]
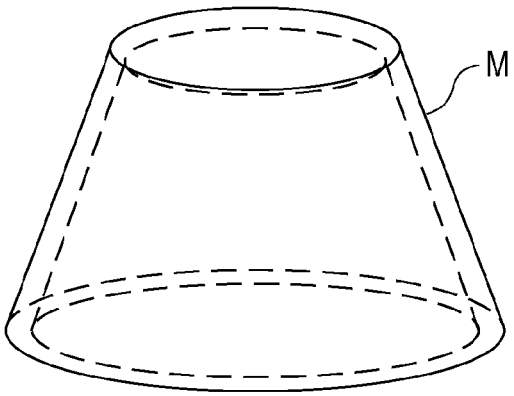

[Fig. 8B]
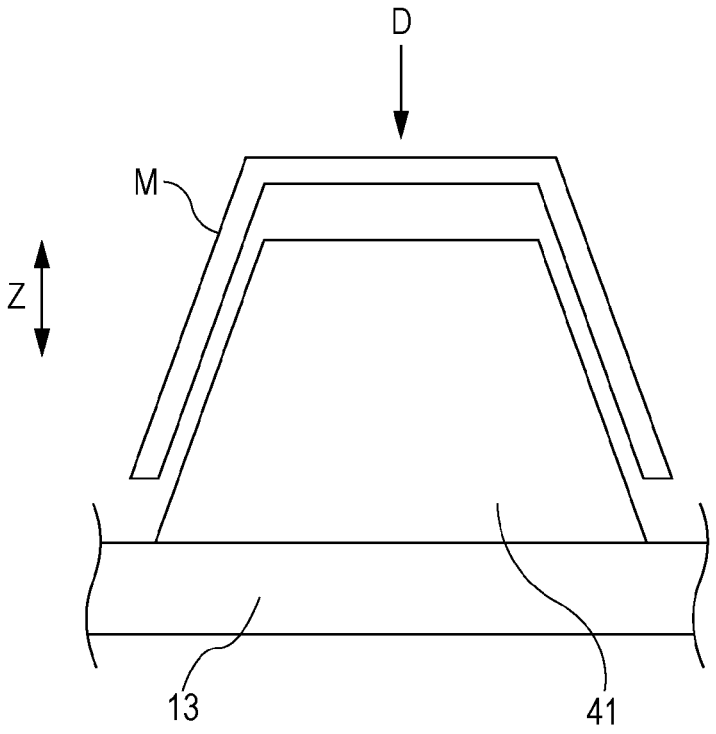
[Fig. 9A]
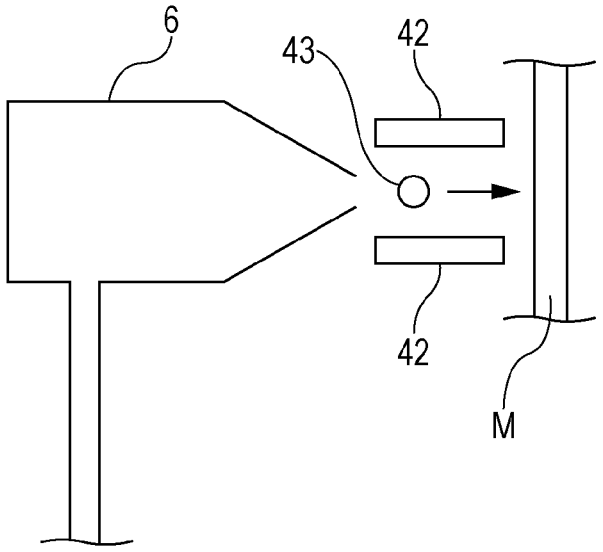

[Fig. 9B]
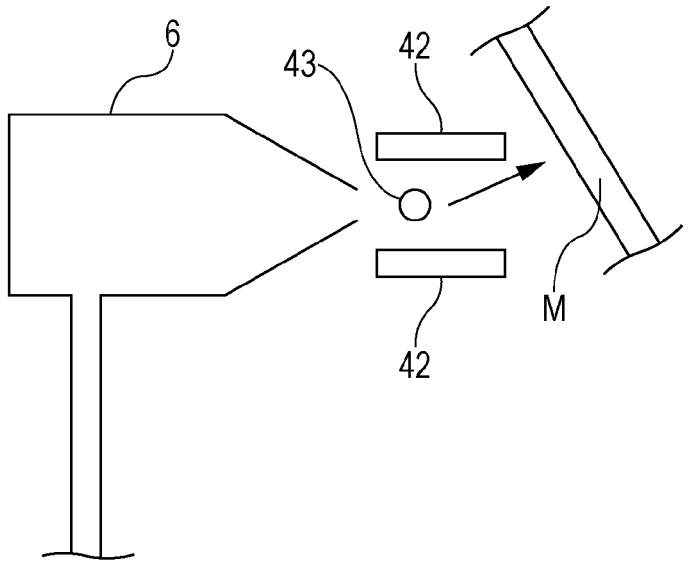

[Fig. 10]
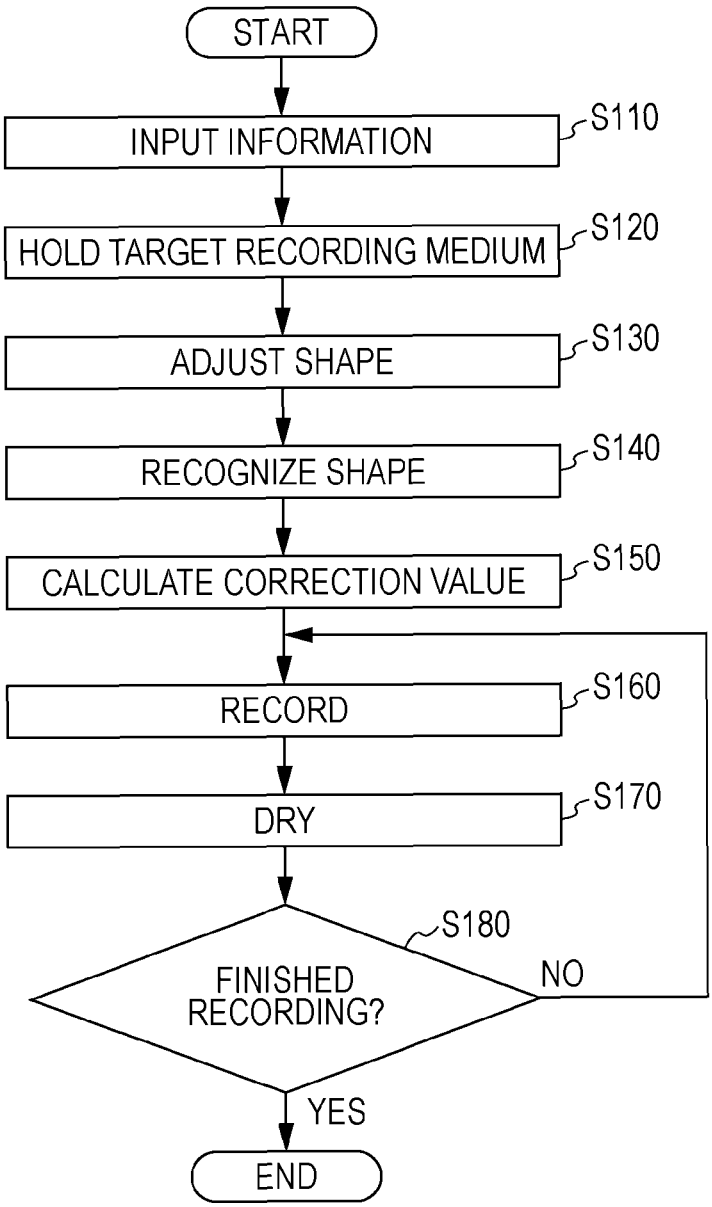

RECORDING APPARATUS AND RECORDING METHOD

TECHNICAL FIELD

The present invention relates to a recording apparatus and a recording method.

BACKGROUND ART

In the related art, recording apparatuses which perform recording by discharging a liquid onto a medium are used. In such a recording apparatus, it is desirable that a distance (commonly-called PG) from a discharging section, which discharges a liquid, to a medium is constant. Thus, for example, PTL 1 discloses a recording apparatus where it is possible to keep PG constant even when warping or the like is generated in a medium.

CITATION LIST

Patent Literature

PTL 1: JP-A-2000-280567

SUMMARY OF INVENTION

Technical Problem

The recording apparatus which is disclosed in PTL 1 is able to keep PG constant with a medium in a sheet form. That is, it is possible to carry out recording corresponding to the shape of a medium in a sheet form.

On the other hand, in recent years, there has been a demand for recording media with various shapes such as three-dimensional shapes and it may be possible for the shape of the medium to change. When it is possible for the shape of the medium to change, the shape is not stable and it may be difficult to suppress deterioration in the quality of the recorded image.

Accordingly, it is an object of the present invention to suppress deterioration in the quality of a recorded image resulting from the shape of a medium not being stable.

Solution to Problem

According to a first aspect of the present invention for solving the problems described above, there is provided a recording apparatus including a shape adjusting section which adjusts a shape of a medium to a reference shape, a holding section which holds a state of the medium after adjustment by the shape adjusting section, and a recording section which has a discharging section which discharges a liquid onto the medium which is held by the holding section.

According to a second aspect of the present invention, the recording apparatus of the first aspect may further include an input section for inputting the reference shape.

According to a third aspect of the present invention, in the recording apparatus of the first or second aspect, the holding section may have a gripping section which holds a state of the medium by gripping the medium.

According to a fourth aspect of the present invention, in the recording apparatus of the third aspect, the gripping section may also serve as the shape adjusting section.

According to a fifth aspect of the present invention, in the recording apparatus of any one of the first to fourth aspects, the shape adjusting section may adjust the shape of the medium by applying tension to the medium.

According to a sixth aspect of the present invention, in the recording apparatus of any one of the first to fifth aspects, the shape adjusting section may adjust the shape of the medium by compressing the medium.

According to a seventh aspect of the present invention, in the recording apparatus of any one of the first to sixth aspects, the shape adjusting section may adjust the shape of the medium by changing pressure of at least one of an interior and an exterior of the medium.

According to an eighth aspect of the present invention, in the recording apparatus of any one of the first to seventh aspects, the medium may have a three-dimensional shape.

According to a ninth aspect of the present invention, there is provided a recording method including a holding step of holding a medium in a state of being adjusted to a reference shape and a recording step of recording by discharging a liquid onto the medium which is held in the holding step.

Advantageous Effects of Invention

According to the present invention, it is possible to suppress deterioration in the quality of a recorded image resulting from the shape of a medium not being stable.

BRIEF DESCRIPTION OF DRAWINGS

FIG. 1 is a schematic diagram which represents a recording apparatus according to a first embodiment of the present invention.

FIG. 2 is a block diagram which represents the recording apparatus according to the first embodiment of the present invention.

FIG. 3 is a schematic diagram which represents main sections of a recording apparatus according to a second embodiment of the present invention.

FIG. 4 is a schematic diagram which represents main sections of a recording apparatus according to a third embodiment of the present invention.

FIG. 5A is a schematic diagram which represents main sections of the recording apparatus according to the third embodiment of the present invention.

FIG. 5B is a schematic diagram which represents main sections of the recording apparatus according to the third embodiment of the present invention.

FIG. 6A is a schematic diagram which represents main sections of a recording apparatus according to a fourth embodiment of the present invention.

FIG. 6B is a schematic diagram which represents main sections of the recording apparatus according to the fourth embodiment of the present invention.

FIG. 7A is a schematic diagram which represents main sections of a recording apparatus according to a fifth embodiment of the present invention.

FIG. 7B is a schematic diagram which represents main sections of the recording apparatus according to the fifth embodiment of the present invention.

FIG. 7C is a schematic diagram which represents main sections of the recording apparatus according to the fifth embodiment of the present invention.

FIG. 8A is a schematic diagram which represents main sections of a recording apparatus according to a sixth embodiment of the present invention.

FIG. 8B is a schematic diagram which represents main sections of the recording apparatus according to the sixth embodiment of the present invention.

FIG. 9A is a schematic diagram which represents main sections of a recording apparatus according to a seventh embodiment of the present invention.

FIG. 9B is a schematic diagram which represents main sections of the recording apparatus according to the seventh embodiment of the present invention.

FIG. 10 is a flowchart of an embodiment of a recording method of the present invention.

DESCRIPTION OF EMBODIMENTS

First Embodiment (FIG. 1 and FIG. 2)

Detailed description will be given below of a recording apparatus according to a first embodiment of the present invention with reference to the accompanying diagrams.

FIG. 1 is a schematic diagram of a recording apparatus 1 of the present embodiment.

The recording apparatus 1 of the present embodiment is provided with a carriage 2 having a recording head 6 as a discharging section which is able to discharge inks (liquid) onto a target recording medium M (a medium) from nozzles and a sensor 9 as a shape recognizing section which recognizes the actual shape of the target recording medium M. Here, the carriage 2 is able to move in direction X along a carriage support shaft 3. In addition, the carriage support shaft 3 is supported by carriage support shaft support sections 4 which have surfaces in a direction which intersects with direction X and is able to be moved in a direction Y by carriage support shaft moving mechanisms 5 which are provided in the carriage support shaft support sections 4. The carriage support shaft support sections 4 are attached in a state of being fixed to a base body section 15 of the recording apparatus 1. Due to this configuration, the carriage 2 is able to move in direction X and direction Y.

Here, in a case where the recording apparatus 1 of the present embodiment is installed on a horizontal surface, direction X and direction Y in FIG. 1 are horizontal directions and direction Z is the vertical direction.

In addition, inks which the recording apparatus 1 of the present embodiment is able to use also include inks for applying glossiness, inks for forming an undercoat layer, inks for forming a protective layer which protects an image which is formed on a recording surface, and the like in addition to color inks such as black, cyan, magenta, and yellow for forming an image on a recording surface of the target recording medium M.

In addition, the recording head 6 is provided so as to be able to move in direction Z with respect to the carriage 2 via a recording head support section 7 and additionally, is configured so as to be able to rotate in a rotation direction R1 with the recording head support section 7 as a rotation axis and so as to be able to rotate in a rotation direction R2 with a rotation shaft 8 as a fulcrum.

Due to this configuration, the recording head 6 of the present embodiment is able to move three-dimensionally with respect to the target recording medium M in direction X, direction Y, and direction Z and it is also possible to adjust the angle and distance thereof with respect to the recording surface to match the shape of the recording surface (ink landing surface) of the target recording medium M. In the present embodiment, recording is carried out such that an ink discharging surface of the recording head 6 is at a predetermined distance (so-called PG) with respect to the recording surface and is substantially parallel thereto (that is, inks land on the recording surface in a substantially orthogonal direction). By carrying out recording in this manner, ink droplets which land on the recording surface form a substantially perfect circle with little variation in diameter (the liquid droplet diameter), and it is possible to carry out high-quality recording.

Here, in the recording apparatus 1 of the present embodiment, due to this configuration, a recording section 44 of the recording apparatus 1 of the present embodiment is configured by the carriage 2, constituent members of the carriage 2 such as the recording head 6, and a moving mechanism which moves the carriage 2 and the recording head 6.

Here, although not shown in detail in the diagram, the sensor 9 of the present embodiment is also able to move with respect to the target recording medium M in the same manner as the recording head 6, and it is also possible to adjust the angle and distance thereof with respect to the target recording medium M in the same manner as the recording head 6. For this reason, it is possible to recognize the shape of the target recording medium M with high precision.

In addition, the recording apparatus 1 of the present embodiment is provided with a holding section 10 which holds the target recording medium M. The holding section 10 is provided with gripping sections 11 which grip the target recording medium M, columns 12 which support the gripping sections 11, and a rotating board 13 to which the columns 12 are attached in a fixed state. Then, the gripping sections 11 are able to rotate in a rotation direction R3 with respect to the columns 12 and the rotating board 13 is able to rotate in a rotation direction R4 with a shaft section 14 as a rotation axis. In addition, a cavity section 17 expanding in direction X and direction Y is provided in the base body section 15 and the rotating board 13 is able to move in direction X and direction Y by a front end section 16 of the shaft section 14 of the rotating board 13 being moved in the cavity section 17. Here, since the holding section 10 of the present embodiment is provided with the gripping sections 11, the holding section 10 is configured to be able to firmly hold the target recording medium M.

Due to this configuration, the holding section 10 is able to make the target recording medium M take various postures and positions with respect to the recording head 6. In addition, a configuration with which it is possible to move the target recording medium M in direction Z in the held state or a configuration which is further provided with a rotating mechanism or the like which has a rotation axis in a direction which intersects with the longitudinal direction of the gripping sections 11 and the direction in which the shaft section 14 extends, may be adopted. By having such a configuration, it is possible to make the target recording medium M take even more postures and positions with respect to the recording head 6.

In addition, the recording apparatus 1 of the present embodiment is provided with a heater 19 as a drying section which dries inks which are discharged from the recording head 6 onto the target recording medium M. Here, the recording apparatus 1 of the present embodiment is provided with the heater 19 as a drying section which dries inks, but may be provided with a drying section with another configuration such as a drying section which carries out drying by ventilation.

In addition, each constituent member in the recording apparatus 1 of the present embodiment is controlled by a control section 18. Then, an instruction section 20, which also has a role as an input section which receives instructions from a user by the user inputting instructions (information), is connected with the control section 18. A PC which is provided with a monitor, a keyboard, a mouse, and the like is used as the instruction section 20 in the present embodiment, but the instruction section 20 may be, for example, a touch panel or the like which is provided in the recording apparatus 1 without being limited to this configuration.

Here, examples of the information (recording information) which the user is able to input in the instruction section 20 include the recorded image information, recording density (resolution), recording speed, inks to be used (including inks to be used for an undercoat layer or an overcoat), and the like; however, without being limited thereto, the information may be a part of the above, or may be different from the above.

Next, description will be given of the electrical configuration in the recording apparatus 1 of the present embodiment.

FIG. 2 is a block diagram of the recording apparatus 1 of the present embodiment.

A CPU 21 which executes overall control of the recording apparatus 1 is provided in the control section 18. The CPU 21 is connected via a system bus 22 with a ROM 23 which stores various types of control programs and the like to be executed by the CPU 21, and a RAM 24 which is able to temporarily store data.

In addition, the CPU 21 is connected via the system bus 22 with a head driving section 25 for driving the recording head 6.

In addition, the CPU 21 is connected via the system bus 22 with a heater driving section 26 for driving the heater 19.

In addition, the CPU 21 is connected via the system bus 22 with a motor driving section 27.

Then, the motor driving section 27 is connected with a carriage driving motor 28 as a discharging section moving mechanism and a holding section driving motor 29 as a holding section moving mechanism.

Here, the carriage driving motor 28 includes all the motors which move the carriage 2 and the constituent members of the carriage 2, such as a motor which moves the carriage 2 in direction X, a motor which moves the carriage support shaft 3 in direction Y, and a motor which rotates and moves the recording head 6 in the rotating directions R1 and R2.

In addition, the holding section driving motor 29 includes all the motors which move the holding section 10 and constituent members of the holding section 10 such as a motor which moves the gripping sections 11 in the rotation direction R3, a motor which moves the rotating board 13 in the rotation direction R4, and a motor which moves the rotating board 13 in direction X and direction Y along the cavity section 17.

Furthermore, the CPU 21 is connected via the system bus 22 with an input and output section 30 and the input and output section 30 is connected with the sensor 9 and the instruction section 20.

The recording apparatus 1 of the present embodiment is able to carry out recording on a three-dimensional target recording medium M, the shape of which is able to be changed and which is configured by a flexible plastic material or the like. By setting a reference shape to be the target recording medium M and carrying out recording on the target recording medium M with the reference shape, it is easy to perform high-quality recording.

Here, the "reference shape" has the meaning of the ideal shape of the target recording medium M when the recording apparatus 1 carries out recording on the target recording medium M, it is possible to arbitrarily determine reference shapes for the shape when manufacturing the target recording medium M, the average shape of the target recording medium M, the shape when using the target recording medium M, or the like, and the shapes thereof are not particularly limited.

Then, in the recording apparatus 1 of the present embodiment, the control section 18 is able to calculate a correction value based on the reference shape of the target recording medium M and the actual shape which is recognized by the sensor 9. That is, the control section 18 also has a role as a calculation section.

Here, performing recording which corresponds to the target recording medium M with a three-dimensional shape is more difficult than performing recording which corresponds to the target recording medium M in a sheet form; however, using the recording apparatus 1 of the present embodiment, it is possible to perform recording more easily corresponding to the target recording medium M with a three-dimensional shape.

In addition, the user is able to input the reference shape using the instruction section 20. It is possible for the user to input the reference shape by selecting from a plurality of reference shapes which are stored in the ROM 23 using a PC as the instruction section 20, and input is also possible by the user drawing a reference shape on the PC and sending the result to the control section 18. In this manner, the user is able to freely select the reference shape and the degree of freedom in selecting the reference shape is expanded.

In this manner, the user inputs a reference shape using the instruction section 20, the control section 18 calculates a correction value with respect to the actual shape of the target recording medium M recognized by the sensor 9, and it is possible for the recording apparatus 1 of the present embodiment to carry out recording by discharging inks from the recording head 6 while adjusting recording conditions based on the correction value.

Then, assuming various types of reference shapes, correction values are calculated corresponding to various types of media. In this manner, the recording apparatus 1 is configured so as to be able to perform recording which corresponds to various media shapes by adjusting the recording conditions based on the correction values.

Here, the method for calculating the correction value is not particularly limited; however, examples thereof include a calculation method for suppressing variations in ink landing positions due to the differences in the incident angle (landing direction) of the inks with respect to the recording surface of the target recording medium M in a case of discharging inks onto a curved surface, or the like. In detail, in a case of carrying out recording onto a curved surface at a constant frequency and with the recording head 6 moving at a constant speed, the landing positions of adjacent inks are close to each other in portions where the incident angle is closer to orthogonal. For this reason, examples include a method for carrying out calculation so as to increase the frequency, decrease the moving speed of the recording head 6, or the like, such that the landing positions of adjacent inks are close to each other in portions where the incident angle is further away from orthogonal. In addition, portions where the incident angle is closer to orthogonal are close to a perfect circle and portions where the incident angle is further away from orthogonal are oval. Thus, in order to suppress deterioration in the image quality due to the above influence, a method for reducing the liquid droplet diameter (increasing the resolution) when discharging inks onto a curved surface, or the like is also included in the examples.

Here, the control section 18 controls the sensor 9 so as to recognize the actual shape of the target recording medium M before moving to the recording operation, that is, when discharging inks onto the target recording medium M. For this reason, since the correction value is calculated based on the shape of the target recording medium M when executing recording, it is possible to perform recording which corresponds to various shapes of the target recording medium M with high precision.

In addition, as for the adjustment of the recording conditions, it is possible to adjust the ink discharging intervals (discharging frequency), the liquid droplet diameter of the ink, the ink discharging speed, the landing angle of the ink with respect to the target recording medium M, and the like. In detail, it is possible to adjust the above by adjusting the size or the waveform of a voltage applied with respect to the recording head 6 and the orientation, position, or the like of the recording head 6 with respect to the target recording medium M.

Here, the recording head 6 of the present embodiment is a recording head which has a piezoelectric element as a recording element. However, a recording head which has a heater as a recording element may be used.

In addition, as further adjustment of the recording conditions, the posture or position of the target recording medium M with respect to the recording head 6 may be adjusted by moving the holding section 10.

However, it is preferable to perform the adjustment for recording by making the recording surface of the target recording medium M substantially horizontal such that ink which lands on the target recording medium M does not move (drip) due to the influence of gravity before drying.

Here, the shape of the target recording medium M may be divided into blocks for each similar portion and the recording conditions may be differentiated for each block.

In addition, in a state where the target recording medium M is firmly gripped by the gripping sections 11, the recording apparatus 1 of the present embodiment is able to adjust the shape of the target recording medium M to a shape which is close to the reference shape using centrifugal force by rotating in the rotation direction R3 with the gripping sections 11 as a rotation axis and rotating in the rotation direction R4 with the shaft section 14 as a rotation axis. That is, the holding section 10 also has a role as a shape adjusting section which adjusts the shape of the target recording medium M to the reference shape. In this manner, deterioration in the quality of the recorded image resulting from the shape of the target recording medium M, the shape of which is able to be changed, not being stable, is suppressed.

In addition, in other words, since the gripping sections 11 also serve as the shape adjusting section, it is not necessary to provide another shape adjusting section, the apparatus configuration is simplified, and costs are lowered.

The recording apparatus 1 of the present embodiment is configured so as to make it possible to remove some of the constituent members or to not use the functions of some of the constituent members and compensate for these functions using other constituent members.

In other words, the recording apparatus 1 of the present embodiment is provided with a first unit which has at least some of the functions which are necessary for recording and a second unit which has different functions from the first unit out of the functions which are necessary for recording, and the first unit and the second unit are operated based on common recording information and the functions of one unit out of the first unit and the second unit are able to compensate for the other unit.

In other words, in a case where the first unit and the second unit lack a function with respect to the functions which are necessary for recording, at least one unit out of the first unit and the second unit has a substitute function with respect to the lacking function.

Due to this configuration, in the recording apparatus 1 of the present embodiment, even in a case where one unit out of the first unit and the second unit malfunctions, the other unit is able to compensate for the functions thereof. In addition, for the purpose of reducing costs or the like, it is possible to remove constituent members which execute this function and it is possible to increase the degree of freedom when combining and recombining the units.

Here, a "unit" implies being formed of one integrated constituent member which has a plurality of functions, or has a meaning including being formed of a plurality of constituent members.

In detail, the recording apparatus 1 of the present embodiment is provided with the instruction section 20 which has an input function for inputting the reference shape of the target recording medium M with a three-dimensional shape, the sensor 9 which has a shape recognizing function for recognizing the actual shape of the target recording medium M, the control section 18 which has a calculation function for calculating a correction value based on the reference shape and the actual shape, the recording head 6 which has a discharging function for discharging inks onto the target recording medium M, and the heater 19 which has a drying function which dries inks which are discharged onto the target recording medium M.

Among these, it is possible to remove, for example, the sensor 9. Then, it is possible to execute recording in a state where the sensor 9 is removed. In this case, for example, it is possible to compensate for the shape recognizing function of the sensor 9 by increasing the precision of the reference shape which is input by the instruction section 20 and inputting a reference shape which is closer to the actual shape. Here, information in which the shape of the target recording medium M is measured beforehand may be input as a reference shape and the precision is further improved by inputting the information which is measured beforehand.

In addition, for example, it is possible to remove the heater 19. Then, it is possible to execute recording in a state where the heater 19 is removed. In this case, for example, the control section 18 is able to compensate for the drying function of the heater 19 by carrying out control such that recording is carried out in a recording mode where the diameter of the ink which is discharged from the recording head 6 is small, carrying out control such that recording is carried out in a recording mode where the recording speed is slow such that the inks easily dry naturally, or the like.

That is, in the recording apparatus 1 of the present embodiment, it is possible to remove at least one unit out of the first unit and the second unit and the other unit is able to compensate for functions lacking due to the removal of the one unit.

Here, in addition to compensating for functions lacking due to the removal of a constituent member, the recording apparatus 1 of the present embodiment is also able to compensate for functions for other reasons. For example, in a case where it is difficult to adjust the incident angle of the ink with respect to the recording surface of the target recording medium M, it is possible to make the control section 18 carry out control such that recording is carried out in a recording mode where the diameter of the inks which is discharged from the recording head 6 is small in order to suppress dripping or the like. In addition, in another example, it is possible to adjust the incident angle of the ink by changing the moving speed of the recording head 6 instead of controlling the ink discharging conditions. Furthermore, in another example, it is possible to compensate for a function for controlling the ink discharging conditions by changing the type of ink which is discharged from the recording head 6 to an ink which dries easily or changing the type of ink which forms the undercoat layer to make it easy to fix the ink.

Furthermore, in a case where there is a function lacking out of the functions described above or other additional functions, the recording apparatus 1 of the present embodiment is configured so as to be able to add a third unit which has a function which corresponds to the lacking function and to be able to compensate for the lacking function.

Here, the recording apparatus 1 of the present embodiment is able to compensate for the functions as described above. For this reason, in addition to compensating for functions lacking due to the removal of a constituent member, in a case where a constituent member malfunctions, it is possible to compensate for the function of the mal-functioning constituent member with another constituent member instead of using that constituent member.

In addition, when installing a new unit by adding or exchanging units, or the like, if the existing unit has various types of setting information, recording information, and shape information including a reference shape, and the like, which the newly installed unit lacks, it is possible to transmit necessary information from the existing unit to the new unit. For this reason, it is possible to easily add new units. In other words, each unit mutually perceives the state of other units and cooperates therewith to set the recording apparatus 1 to a suitable state which corresponds to the configuration of units.

Second Embodiment (FIG. 3)

Next, detailed description will be given of the recording apparatus 1 of a second embodiment with reference to the accompanying diagrams.

FIG. 3 is a schematic diagram which represents the holding section 10 which is a main section of the recording apparatus 1 of the second embodiment. Here, constituent members which are common to the embodiment described above are shown with the same reference numerals and detailed description thereof will be omitted.

Here, the recording apparatus 1 of the present embodiment has the same configuration as the recording apparatus 1 of the first embodiment except that the holding section 10 is able to hold a plurality of the target recording media M so as to be able to move.

As represented in FIG. 3, in the recording apparatus 1 of the present embodiment, setting positions for the target recording medium M formed of the gripping sections 11 and the columns 12 are provided at four locations on the rotating board 13. By having this configuration, recording is carried out corresponding to any of the target recording media M with a three-dimensional shape set at the four locations, and productivity (the total recording speed with respect to a plurality of the target recording media M) is improved.

Here, after recording on the first target recording medium M ends out of the recording with respect to the four target recording media M which are held by the holding section 10, when performing recording with respect to the second or subsequent target recording media M, the shape recognition of the recording medium M by the sensor 9 may be omitted and shape recognition information for the first target recording medium M may be used.

Third Embodiment (FIG. 4 to FIG. 5B)

Next, detailed description will be given of the recording apparatus 1 of a third embodiment with reference to the accompanying diagrams.

FIG. 4 and FIGS. 5A and 5B are schematic diagrams which represent the holding section 10 which is a main section of the recording apparatus 1 of the third embodiment. Here, constituent members which are common to the embodiments described above are shown with the same reference numerals and detailed description thereof will be omitted.

Here, the recording apparatus 1 of the present embodiment has the same configuration as the recording apparatus 1 of the first embodiment and the second embodiment apart from the holding section 10.

The recording apparatus 1 of the first embodiment and the second embodiment has a configuration which grips and holds the target recording medium M with the gripping sections 11 from the direction which intersects with direction Z. On the other hand, the recording apparatus 1 of the present embodiment has a configuration which fits and holds the target recording medium M in a cylindrical setting section 31 in direction Z as represented in FIG. 4.

In addition, as represented in FIG. 4, a rectangular hole section 32 is configured in the setting section 31 and the recording apparatus 1 has a configuration which executes recording with respect to the target recording medium M which is set in the setting section 31 via the hole section 32 by arranging the recording head 6 at a position which opposes the hole section 32. Since the recording apparatus 1 of the present embodiment has this configuration, the user sets the target recording medium M in the setting section 31 such that a portion which the user wants to record on in the target recording medium M corresponds to the hole section 32.

In addition, as represented in FIG. 5B, the holding section 10 of the present embodiment is provided with a shape adjusting section 33 which is able to adjust the shape of the target recording medium M by injecting air (that is, applying pressure) into the interior of the target recording medium M. The shape adjusting section 33 has a tube section 34 and a lid section 35 and adjusts the shape of the target recording medium M by injecting air into the interior of the target recording medium M, the shape of which is changed as represented in FIG. 5A. Here, the holding section 10 of the present embodiment is configured to be provided with one shape adjusting section 33; however, without being limited to this configuration, the holding section 10 may be configured to be provided with a plurality of the shape adjusting sections 33 corresponding to each of the setting sections 31.

In this manner, the recording apparatus 1 of the present embodiment has a configuration which adjusts the shape of the target recording medium M by applying pressure to the interior thereof; however, the recording apparatus 1 may have a configuration, for example, which adjusts the shape by reducing the pressure of the exterior of the target recording medium M so as to be lower than on the interior. That is, it is sufficient if the configuration is able to adjust the shape of the target recording medium M by changing the pressure on at least one of the interior and the exterior of the target recording medium M. This is because, for the target recording medium M or the like which is used in the present embodiment, it is possible to adjust the shape of the target recording medium M with high precision with this configuration.

Fourth Embodiment (FIGS. 6A and 6B)

Next, detailed description will be given of the recording apparatus 1 of a fourth embodiment with reference to the accompanying diagrams.

FIGS. 6A and 6B are schematic diagrams which represent the holding section 10 which is a main section of the recording apparatus 1 of the fourth embodiment. Here, constituent members which are common to the embodiments described above are shown with the same reference numerals and detailed description thereof will be omitted.

Here, the recording apparatus 1 of the present embodiment has the same configuration as the recording apparatus 1 of the first embodiment, the second embodiment, and the third embodiment apart from the holding section 10.

The recording apparatus 1 of the third embodiment has a configuration which adjusts the shape of the target recording medium M by injecting air to the interior of the target recording medium M. On the other hand, the recording apparatus 1 of the present embodiment has a configuration which adjusts the shape of the target recording medium M by reducing the pressure of the interior of the target recording medium M.

The target recording media M have various shapes; however, for example, as represented in FIG. 6A, there is a target recording medium M in the form of a bag which has a gusset section 37 for increasing the internal volume, and a reinforcing section 36 for suppressing bending and the like.

In a case of recording on the target recording medium M, the recording is easier and the recording quality is improved in a state where the target recording medium M is shrunk than in a state where the target recording medium M is expanded, due to the recording surface having a planar form.

The recording apparatus 1 of the present embodiment is particularly effective in a case of performing recording on such a target recording medium M.

As represented in FIG. 6B, the holding section 10 of the present embodiment is provided with the shape adjusting section 33 which is able to adjust the shape of the target recording medium M by drawing air from the interior of the target recording medium M. The shape adjusting section 33 has a tube section 38 and adjusts the shape of the target recording medium M by drawing air from the interior from the target recording medium M in a bag form with air in the interior as represented in FIG. 6B. Here, the holding section 10 of the present embodiment is configured to be provided with one shape adjusting section 33; however, without being limited to this configuration, the holding section 10 may be configured to be provided with a plurality of the shape adjusting sections 33 corresponding to each of the setting sections 31.

In this manner, the recording apparatus 1 of the present embodiment has a configuration which adjusts the shape of the target recording medium M by compression by reducing pressure of the interior of the target recording medium M; however, the recording apparatus 1 may have a configuration, for example, which adjusts the shape of the target recording medium M by compression by a method other than the method for reducing pressure of the interior of the target recording medium M. That is, it is sufficient if the configuration is able to adjust the shape of the target recording medium M by compressing the target recording medium M. This is because, for the target recording medium M or the like which is used in the present embodiment, it is possible to adjust the shape of the target recording medium M with high precision with this configuration.

Fifth Embodiment (FIGS. 7A to 7C)

Next, detailed description will be given of the recording apparatus 1 of a fifth embodiment with reference to the accompanying diagrams.

FIGS. 7A to 7C are schematic diagrams which represent the holding section 10 which is a main section of the recording apparatus 1 of the fifth embodiment. Here, constituent members which are common to the embodiments described above are shown with the same reference numerals and detailed description thereof will be omitted.

Here, the recording apparatus 1 of the present embodiment has the same configuration as the recording apparatus 1 of the first embodiment, the second embodiment, the third embodiment, and the fourth embodiment apart from the holding section 10.

The recording apparatus 1 of the third embodiment has a configuration which adjusts the shape of the target recording medium M by injecting air into the interior of the target recording medium M and the recording apparatus 1 of the fourth embodiment has a configuration which adjusts the shape of the target recording medium M by reducing pressure of the interior of the target recording medium M. On the other hand, the recording apparatus 1 of the present embodiment has a configuration which adjusts the shape of the target recording medium M by applying tension to the target recording medium M.

The target recording media M have various shapes; however, for example, there is a target recording medium M which does not have the reinforcing section 36 as represented in FIG. 6A, the shape of which is easily changed. FIG. 7A is a diagram in which the target recording medium M in a bag form, the shape of which is easily changed, is viewed from a direction which intersects the recording surface of the target recording medium M, and a diagram in which the upper section in the diagram represents a side which is able to be opened and closed in the target recording medium M in a bag form.

In a case of recording on the target recording medium M, since the recording surface is a curved surface in a state where the target recording medium M is expanded and wrinkles are easily generated in the recording surface in a state where the target recording medium M is shrunk, the recording is easier and the recording quality is improved when tension is applied to the target recording medium M, due to the recording surface having a planar form.

The recording apparatus 1 of the present embodiment is particularly effective in a case of performing recording on such a target recording medium M.

The holding section 10 of the present embodiment is provided with the shape adjusting section 33 which is able to adjust the shape of the target recording medium M by applying tension to the target recording medium M as represented in FIG. 7B. The shape adjusting section 33 has gripping sections 39 and a plurality (for example, two) of the gripping sections 39 pinch both end portions of the target recording medium M by applying pressure in a thickness direction A of the target recording medium M, and apply tension to the target recording medium M by applying force in a direction B which draws out the target recording medium M with respect to the plurality of gripping sections 39.

In this manner, the recording apparatus 1 of the present embodiment has a configuration which adjusts the shape of the target recording medium M by applying tension to the target recording medium M. The shape of the target recording medium M is adjusted with high precision with this configuration.

Here, as a modified example of the holding section 10 of the present embodiment, as represented in FIG. 7C, there may be a configuration which provides a planar member 40 on the opposite side to the recording surface of the target recording medium M, and which pushes the target recording medium M, which is in a state of being gripped by two of the gripping sections 39, against the planar member 40 (applying force in a direction C). By having this configuration, it is possible to set the recording surface to have a more planar shape.

Sixth Embodiment (FIGS. 8A and 8B)

Next, detailed description will be given of the recording apparatus 1 of a sixth embodiment with reference to the accompanying diagrams.

FIGS. 8A and 8B are schematic diagrams which represent the holding section 10 which is a main section of the recording apparatus 1 of the sixth embodiment. Here, constituent members which are common to the embodiments described above are shown with the same reference numerals and detailed description thereof will be omitted.

Here, the recording apparatus 1 of the present embodiment has the same configuration as the recording apparatus 1 of the first embodiment, the second embodiment, the third embodiment, the fourth embodiment, and the fifth embodiment apart from the holding section 10.

The target recording media M have various shapes; however, for example, there is a target recording medium M which is in a cup form as represented in FIG. 8A, the shape of which is easily changed. FIG. 8A is a diagram where the opening section of the target recording medium M in a cup form, the shape of which is easily changed, is represented as pointing down.

In a case of recording on the target recording medium M, a holding section 41, which has a shape corresponding to the shape of the inner side portion of the target recording medium M set to a reference shape, is covered by the target recording medium M from the direction D so as to enter inside the target recording medium M, and it is possible to carry out recording by stably holding the target recording medium M in a state close to the reference shape due to the target recording medium M being supported by the holding section 41.

Thus, the recording apparatus 1 of the present embodiment is provided with the holding section 41 with a shape which corresponds to the shape of the inner side portion of the target recording medium M set to the reference shape. For this reason, the recording apparatus 1 of the present embodiment is particularly effective in a case of performing recording on such a target recording medium M.

Seventh Embodiment (FIGS. 9A and 9B)

Next, detailed description will be given of the recording apparatus 1 of a seventh embodiment with reference to the accompanying diagrams.

FIGS. 9A and 9B are schematic diagrams which represent the recording section 44 which is a main section of the recording apparatus 1 of the seventh embodiment. Here, constituent members which are common to the embodiments described above are shown with the same reference numerals and detailed description thereof will be omitted.

Here, the recording apparatus 1 of the present embodiment has the same configuration as the recording apparatus 1 of the first embodiment apart from being provided with an electrode section 42 in the vicinity of nozzles of the recording head 6 in the recording section 44.

It is possible to use inks which have electrical charges in the recording apparatus 1 of the present embodiment. For this reason, by using inks which have electrical charges and applying a voltage to the electrode section 42, it is possible to change (adjust) the discharging direction of the inks which are discharged from the recording head 6. In detail, for example, as represented in FIG. 9A, in a case where the recording surface of the target recording medium M is in a substantially orthogonal state with respect to the discharging direction of ink droplets 43 which are discharged from the recording head 6, it is possible to form ink dots in substantially perfect circles by landing the ink droplets 43 on the recording surface of the target recording medium M as is without applying a voltage to the electrode section 42. On the other hand, as represented in FIG. 9B, in a case where the recording surface of the target recording medium M is not in an orthogonal state with respect to the discharging direction of the ink droplets 43 which are discharged from the recording head 6, it is possible to form ink dots in substantially perfect circles by adjusting the discharging direction of the ink droplets 43 by applying a voltage to the electrode section 42 and landing the ink in a direction substantially orthogonal to the recording surface of the target recording medium M. In this manner, it is possible to perform recording which corresponds to media with various shapes.

Here, the recording apparatus 1 of the present embodiment has a configuration which is able to adjust the discharging direction (the landing direction) of inks by using inks which have electrical charges; however, there may be a configuration which applies electrical charges to inks which are discharged from the recording head 6 by providing a charging section which electrically charges inks which do not have electrical charges.

Embodiment of Recording Method (FIG. 10)

Next, description will be given of an embodiment of a recording method which uses the recording apparatus 1 of the first embodiment. FIG. 10 is a flowchart of the recording method of the present embodiment.

Firstly, in an information inputting process in Step S110, the user inputs various types of recording information such as the reference shape of the target recording medium M, recorded image information, recording density, recording speed, and inks to be used using the instruction section 20.

Next, in a target recording medium holding process in Step S120, the user makes the holding section 10 hold the target recording medium M. In detail, the target recording medium M is held by the holding section 10 by the target recording medium M being gripped by two of the gripping sections 11.

Next, in a shape adjusting process in Step S130, the shape of the target recording medium M is adjusted to a shape which is close to the reference shape using centrifugal force by rotating the gripping sections 11 in the rotation direction R3 and rotating in the rotation direction R4 with the shaft section 14 as the rotation axis. Here, it is also possible to omit the present step. In a case of omitting the present step, the function thereof is compensated for by adjusting the recording conditions in a recording process in the subsequent Step S160 instead of omitting the use of the function of adjusting the shape of the target recording medium M accompanying the present step.

Here, the target recording medium M is held in the reference shape state due to the present step.

Next, in a shape recognizing process in Step S140, the actual shape of the target recording medium M which is held by the holding section 10 is recognized by the sensor 9. Here, it is also possible to omit the present step. In a case of omitting the present step, the function thereof is compensated for by carrying out recording in the recording process of the subsequent Step S160 based on the reference shape input by the user in the information inputting process in Step S110 instead of omitting the use of the shape recognizing function accompanying the present step and additionally omitting calculation of a correction value in a correction value calculating process of the next Step S150.

Next, in the correction value calculating process in Step S150, a correction value is calculated by the control section 18 based on the reference shape input by the user in the information inputting process in Step S110 and the actual shape of the target recording medium M recognized by the sensor 9 in the shape recognizing process in Step S140.

Here, in the present step, in addition to the calculation of the correction value, appropriate recording conditions (ink discharging intervals, the liquid droplet diameter of the ink, the ink discharging speed, the landing angle of the ink with respect to the target recording medium M, a posture or position of the target recording medium M with respect to the recording head 6, and the like) are also set by the control section 18.

Next, in the recording step in Step S160, recording is performed by discharging a desired ink from the recording head 6 based on the correction value which is calculated in the correction value calculating process in Step S150 and the set recording conditions. Here, in the present embodiment, recording is performed in the order of an undercoat layer, an image forming layer, and an overcoat layer; however, at least one of the undercoat layer and the overcoat layer may be omitted.

In addition, after ending the recording process in Step S160 or along with the recording process in Step S160, inks which are discharged onto the target recording medium M are dried by the heater 19 in a drying process in Step S170. Here, it is also possible to omit the present step. In a case of omitting the present step, the function thereof is compensated for by omitting the use of the drying function accompanying the present step and adjusting the recording conditions which are set by the control section 18, for example, by carrying out control such that recording is carried out in a recording mode where the diameter of the ink which is discharged from the recording head 6 is small, or carrying out control such that recording is carried out in a recording mode where the recording speed is slow such that the inks easily dry naturally.

Then, in a recording ending determination process in Step S180, it is determined whether or not the recording is ended based on the recording data and the flow returns to the recording process in Step S160 in a case where it is determined that the recording is not ended and the recording method of the present embodiment is ended in a case where it is determined that the recording is ended.

According to the recording method of the present embodiment, since recording is carried out while stabilizing the shape of the target recording medium M and holding this state, it is possible to suppress deterioration in the quality of a recorded image resulting from the shape of the target recording medium M not being stable.

Here, the present invention is not limited to the embodiments described above and various modifications are possible within the range of the invention described in the claims and, needless to say, these modifications are included in the range of the present invention.

Detailed description was given above of the present invention based on the specific embodiments. Here, the present invention will be summarized once more.

According to the first aspect of the present invention, there is provided the recording apparatus 1 including a shape adjusting section 11 which adjusts a shape of a medium M to a reference shape, the holding section 10 which holds a state of the medium M after adjustment by the shape adjusting section 11, and the recording section 44 which has the discharging section 6 which discharges a liquid onto the medium M which is held by the holding section 10.

Here, the "reference shape" has the meaning of the ideal shape of the medium M when the recording apparatus 1 carries out recording on the medium M and the shape thereof is not particularly limited.

According to the present embodiment, the shape adjusting section 11 which adjusts the shape of the medium M to the reference shape is provided. That is, it is possible to stabilize the shape of the medium M and the holding section 10 is able to hold this state. Accordingly, it is possible to suppress deterioration in the quality of a recorded image resulting from the shape of the medium M not being stable.

According to the second aspect of the present invention, the recording apparatus 1 of the first aspect is provided with the instruction section 20 for inputting the reference shape.

According to the present aspect, the instruction section 20 for inputting the reference shape is provided. For this reason, since the user is able to freely select the reference shape, it is possible to expand the degree of freedom in selecting the reference shape.

According to the third aspect of the present invention, in the recording apparatus 1 of the first or second aspect, the holding section 10 has the gripping sections 11 which hold a state of the medium M by gripping the medium M.

According to the present aspect, the holding section 10 has the gripping sections 11 which hold a state of the medium M by gripping the medium M. For this reason, it is possible to firmly hold the medium M by gripping the medium M.

According to the fourth aspect of the present invention, in the recording apparatus 1 of the third aspect, the gripping sections 11 also serve as the shape adjusting section.

According to the present aspect, the gripping sections 11 also serve as the shape adjusting section. For this reason, the gripping sections 11 are able to hold the medium M and are also able to adjust the shape of the medium M. Accordingly, it is not necessary to provide another shape adjusting section and it is possible to simplify the apparatus configuration and lower costs.

According to the fifth aspect of the present invention, in the recording apparatus 1 of any one of the first to fourth aspects, the shape adjusting section 11 adjusts the shape of the medium M by applying tension to the medium M.

According to the present aspect, the shape adjusting section 11 adjusts the shape of the medium M by applying tension to the medium M. For this reason, in particular, in a case of using the medium M where adjustment of the shape of the medium M is highly precise by adjusting the shape by applying tension, it is possible to adjust the shape of the medium M with high precision.

According to the sixth aspect of the present invention, in the recording apparatus 1 of any one of the first to fifth aspects, the shape adjusting section 11 adjusts the shape of the medium M by compressing the medium M.

According to the present aspect, the shape adjusting section 11 adjusts the shape of the medium M by compressing the medium M. For this reason, in particular, in a case of using the medium M where adjustment of the shape of the medium M is highly precise by adjusting the shape by compressing, it is possible to adjust the shape of the medium M with high precision.

According to the seventh aspect of the present invention, in the recording apparatus 1 of any one of the first to sixth aspects, the shape adjusting section 11 adjusts the shape of the medium M by changing pressure of at least one of the interior and the exterior of the medium M.

According to the present aspect, the shape adjusting section 11 adjusts the shape of the medium M by changing pressure of at least one of the interior and the exterior of the medium M. For this reason, in particular, in a case of using the medium M where adjustment of the shape of the medium M is highly precise by adjusting the shape by changing pressure of at least one of the interior and the exterior of the medium M, it is possible to adjust the shape of the medium M with high precision.

According to the eighth aspect of the present invention, in the recording apparatus 1 of any one of the first to seventh aspect, the medium M has a three-dimensional shape.

It is more difficult to make the shape of the medium M with a three-dimensional shape stable than to make the shape of the medium M in a sheet form stable; however, according to the present aspect, it is possible to stabilize the shape even when the medium M has a three-dimensional shape.

According to the ninth aspect of the present invention, there is provided a recording method including a holding step of holding the medium M in a state of being adjusted to a reference shape and a recording step of recording by discharging a liquid onto the medium M which is held in the holding step.

According to the present aspect, the medium M is held in a holding step in a state of being adjusted to a reference shape. That is, it is possible to stabilize the shape of the medium M and it is possible to hold this state. Accordingly, it is possible to suppress deterioration in the quality of a recorded image resulting from the shape of the medium M not being stable.

The entire disclosure of Japanese Patent Application No. 2014-142941, filed Jul. 11, 2014 is expressly incorporated by reference herein.

REFERENCE SIGNS LIST

1 RECORDING APPARATUS
2 CARRIAGE
3 CARRIAGE SUPPORT SHAFT
4 CARRIAGE SUPPORT SHAFT SUPPORT SECTION
5 CARRIAGE SUPPORT SHAFT MOVING MECHANISM
6 RECORDING HEAD (DISCHARGING SECTION)
7 RECORDING HEAD SUPPORT SECTION
8 ROTATION SHAFT
9 SENSOR (SHAPE RECOGNITION SECTION)
10 HOLDING SECTION
11 GRIPPING SECTION (SHAPE ADJUSTING SECTION)
12 COLUMN
13 ROTATING BOARD
14 SHAFT SECTION
15 BASE BODY SECTION
16 FRONT END SECTION
17 CAVITY SECTION
18 CONTROL SECTION (CALCULATION SECTION)
19 HEATER (DRYING SECTION)
20 INSTRUCTION SECTION
21 CPU
22 SYSTEM BUS
23 ROM
24 RAM
25 HEAD DRIVING SECTION
26 HEATER DRIVING SECTION
27 MOTOR DRIVING SECTION
28 CARRIAGE DRIVING MOTOR (DISCHARGING SECTION MOVING MECHANISM)
29 HOLDING SECTION DRIVING MOTOR
30 INPUT AND OUTPUT SECTION
31 SETTING SECTION
32 HOLE SECTION
33 SHAPE ADJUSTING SECTION
34 TUBE SECTION
35 LID SECTION
36 REINFORCING SECTION
37 GUSSET SECTION
38 TUBE SECTION
39 GRIPPING SECTION
40 PLANAR MEMBER
41 HOLDING SECTION
42 ELECTRODE SECTION
43 INK DROPLET
44 RECORDING SECTION
M TARGET RECORDING MEDIUM

The invention claimed is:

1. A recording apparatus comprising:
a shape adjusting section which adjusts a shape of a medium to a reference shape;
a sensor which senses an actual shape of the medium;
a holding section which holds a state of the medium after adjustment by the shape adjusting section; and
a recording section which has a discharging section which discharges a liquid onto the medium which is held by the holding section, the recording section discharging the liquid on the medium based on a calculated correction value based on the reference shape of the medium and the actual shape of the medium.

2. The recording apparatus according to claim 1, further comprising:
an input section for inputting the reference shape.

3. The recording apparatus according to claim 1,
wherein the holding section has a gripping section which holds a state of the medium by gripping the medium.

4. The recording apparatus according to claim 3,
wherein the gripping section also serves as the shape adjusting section.

5. The recording apparatus according to claim 1,
wherein the shape adjusting section adjusts the shape of the medium by applying tension to the medium.

6. The recording apparatus according to claim 1, wherein the shape adjusting section adjusts the shape of the medium by compressing the medium.

7. The recording apparatus according to claim 1, wherein the shape adjusting section adjusts the shape of the medium by changing pressure of at least one of an interior and an exterior of the medium.

8. The recording apparatus according to claim 1, wherein the medium has a three-dimensional shape.

9. A recording method comprising:

a holding step of holding a medium in a state of being adjusted to a reference shape; and a recording step of recording by discharging a liquid onto the medium which is held in the holding step, the recording being based on a calculated correction value that is based on the reference shape of the medium and an actual shape of the medium sensed by a sensor.

* * * * *